US006062113A

United States Patent [19]

Nakano et al.

[11] Patent Number: 6,062,113

[45] Date of Patent: May 16, 2000

[54] PNEUMATICALLY OPERATED SCREW DRIVER HAVING MECHANISM FOR ASSISTING SEPARATION OF SCREW FROM SCREW BAND

[75] Inventors: Yoshihiro Nakano; Isamu Tanji, both of Hitachinaka, Japan

[73] Assignee: Hitachi Koki Co., Ltd., Tokyo, Japan

[21] Appl. No.: 09/264,038

[22] Filed: Mar. 8, 1999

[30] Foreign Application Priority Data

Mar. 16, 1998 [JP] Japan ..... 10-065613
May 20, 1998 [JP] Japan ..... 10-138992

[51] Int. Cl.[7] ..... B25B 23/04

[52] U.S. Cl. ..... 81/434; 81/57.37; 81/433

[58] Field of Search ..... 81/431–434, 57.37, 81/37

[56] References Cited

U.S. PATENT DOCUMENTS

| | | | |
|---|---|---|---|
| 3,971,421 | 7/1976 | Damratowski | 81/434 |
| 5,425,293 | 6/1995 | Nakazato et al. | 81/433 |
| 5,862,724 | 1/1999 | Arata et al. | 81/57.37 |
| 5,974,918 | 11/1999 | Nakagawa et al. | 81/434 |

FOREIGN PATENT DOCUMENTS

| | | | |
|---|---|---|---|
| 0 491 484 | 6/1992 | European Pat. Off. | B25B 23/04 |
| 197 16 132 | 10/1997 | Germany | B25B 23/06 |

*Primary Examiner*—James G. Smith
*Assistant Examiner*—Lee Wilson
*Attorney, Agent, or Firm*—Sughrue, Mion, Zinn Macpeak & Seas, PLLC

[57] ABSTRACT

A pneumatically operated screw driver includes a mechanism for assisting separation of screw from a screw band. The band is made of a deformable material to which a plurality of screws are detachably held. The band has one side where a head of the screw is exposed, and has another side from which a threaded portion of the screw extends. The screw driver includes a housing, a slide member, a pneumatic motor and a drive bit driven by the pneumatic motor and movable in an axial direction thereof and rotatable about the axis. The slide member is slidable in the axial direction, and is formed with a screw passage. The other side of the screw band is pressed onto a wall of the slide member. Shearing deformation occurs in the screw band when the drive bit presses the head of the screw while the other side of the screw band is held by the wall, thereby separating the screw from the screw band. A sub-piston cylinder is provided beside the housing and, a sub-piston connected to the slide member is disposed in the cylinder. A compressed air is introduced into a sub-piston chamber from the pneumatic motor to move the sub-piston, thereby moving the slide member at a phase of separation of the screw from the screw band.

8 Claims, 14 Drawing Sheets

PNEUMATICALLY OPERATED SCREW DRIVER HAVING MECHANISM FOR ASSISTING SEPARATION OF SCREW FROM SCREW BAND

BACKGROUND OF THE INVENTION

The present invention relates to a pneumatically operated screw driver, and more particularly, to the screw driver having a mechanism for assisting separation of a screw from a screw band.

A pneumatically operated screw driver uses a screw band to which a plurality of screws are arrayed and held. The screw band is made of a resin material, and each head of the screw can be removed from the screw band by the deformation thereof upon application of shearing force to the screw band.

A conventional electrically operated screw driver shown in FIGS. 13 and 14 includes a main body 1 having a housing 4 and a nose portion 18. The housing 4 has a handle 4*a* at a rearmost side of the screw driver and houses therein an electric motor 2. The nose portion 18 has an abutment piece 63 at a frontmost side thereof with which a workpiece 42 is abuttable. A plurality of screws 44 are arrayed in line and held with a constant interval by a screw band 43 held at a tip end of the nose portion 18. More specifically, the screw band 43 has one longitudinal side where each head of the screw 44 is exposed, and has another longitudinal side in contactable with a first slide member 32 described later. A drive bit 16 extends through the nose portion 18. The drive bit 16 is movable in its axial direction and rotatable about its axis by the rotation force of the electric motor 2. The tip end of the drive bit 18 has a cruciform shape to engage a cruciform groove formed at the head of the screw 44.

The nose portion 18 has the first slide member 32, a second slide member 33, a casing 34, and springs 38 and 39. The first slide member 32 is positioned at the front end of the nose portion 18, and has a sprocket 49 engageable with the screw band 43. The first slide member 32 has a flat surface 40 where a groove 41 is formed. The first slide member 32 is formed with a circular screw passage (not shown). The second slide member 33 is positioned immediately behind the first slide member 32. The spring 39 is interposed between the casing 34 and the second slide member 33 for urging the second slide member 33 frontwardly. Further, the spring 38 is interposed between the first and second slide members 32 and 33 for urging the first slide member 32 frontwardly. The second slide member 33 has a roller 36 selectively positioned on the flat surface 40 or engageable with the groove 41. The second slide member 33 also has a feed pawl 50 engageable with the sprocket 49 for rotating the sprocket 49 upon relatively frontward movement of the second slide member 33 with respect to the first slide member 32. The second slide member 33 is slidable with respect to an inner surface of the casing 34. In the inner surface of the casing 34, an engagement groove 34*a* is formed with which the roller 36 can be selectively engaged.

In a non-operation state, the roller 36 is engaged with the engagement groove 34*a* of the casing 34 and rides on the flat surface 40 of the first slide member 32. Upon frontward movement of the main body 1 with respect to a workpiece 42 after abutting the abutment piece 63 against the workpiece 42, the first slide member 32 is moved into the casing 34 against the biasing force of the spring 38. Therefore, the feed pawl 50 pushes the sprocket 49 to rotate the sprocket 49, so that the leading end screw 44 held by the screw band 43 is fed to the position in front of the drive bit 16 in axial alignment therewith. In this case, the second slide member 33 is maintained at its frontward position by the biasing force of the spring 39 and engagement of the roller 36 with the engagement groove 34*a*.

On the way to rearward movement of the first slide member 32, the roller 36 which has been riding on the flat surface 40 is then disengaged from the engagement groove 34*a* and brought into engagement with the groove 41. Thus, the second slide member 33 is released from the casing 34 and engaged with the first slide member 32. Accordingly, the first and second slide members 32 and 33 are moved together into the casing 34. In the rearward movement of the first and second slide members 32 and 33, the drive bit 16 is brought into engagement with the cruciform groove of the head of the screw 44, and the screw band 43 is pressed onto the inner wall of the first slide member 32 in accordance with the rearward movement of the first slide member 32. The screw band 43 is deformed along the circular screw passage formed in the first slide member 32. If the deformation of the screw band 43 exceeds the screw holding force, the screw 44 can be separated from the screw band 43, and passes along the screw passage and screwed into the workpiece 42. If the main body 1 is moved away from the workpiece 42, the first and second slide members 32 and 33 are moved to their original positions by the biasing forces of the springs 38 and 39.

With the above-described conventional arrangement, the screw band 43 is conically deformed for separating the screw 44 from the screw band 43, because the screw band 43 slidingly passes through a circular screw passage formed in the first slide member 32 while being pressed by the head of the screw 44. As a result, relatively large shearing force is required for separating the screw 44 from the screw band 43. To this effect, a sufficiently large scale force is required to manually press the entire screw driver against the workpiece 42 so as to sustain the separation force. This degrades the operability of the screw driver.

SUMMARY OF THE INVENTION

It is therefore an object of the present invention to provide an improved pneumatically operated screw driver capable of providing an excellent operability in which a large scale pressing force for pressing the entire screw driver against the workpiece is not required.

Still another object of the present invention is to provide the screw driver capable of maintaining an accurate orientation of a screw after the screw is released from the screw band.

Still another object of the present invention is to provide the screw driver capable of maintaining an accurate posture of the entire screw driver with respect to the workpiece after separation of the screw from the screw band.

The first object of the present invention will be attained by providing an improved pneumatically operated screw driver connected to a compressed air source for driving a screw held by a screw band into a workpiece. The screw band detachably holds a plurality of screws arrayed in line with a constant interval, and the screw band has one side where each head of each screw is exposed, and has another side from which each threading portion of each screw extends. The improved screw driver includes a mechanism for facilitating a separation of the screw from the screw band in addition to a housing, a pneumatic motor, a drive bit, a casing, and a slide mechanism. The housing is formed with an compressed air inlet connected to the compressed air source. The pneumatic motor is disposed in the housing and is selectively communicated with the compressed air source. The pneumatic motor is driven by a compressed air supplied from the compressed air source. The drive bit is disposed in the housing and is rotationally driven by the pneumatic motor. The drive bit has a tip end engageable with the head of the screw held in the screw band. The casing is supported to the housing and extends in the axial direction of the drive bit. The slide mechanism is slidably disposed in the casing. The slide mechanism is slidable upon pressing the housing onto the workpiece. The slide mechanism has a front portion provided with a screw feed mechanism movably holding the screw band for feeding each screw held by the screw band to a position adjacent the tip end of the drive bit and in axial alignment therewith in accordance with the sliding movement of the slide mechanism. The head of each screw is pressed by the tip end of the drive bit, and the another side of the screw band is supported by the slide mechanism. The facilitating mechanism includes a sub-piston cylinder, a sub-piston, a piston rod, and means for introducing a compressed air. The sub-piston cylinder is disposed at the housing and extends in a direction parallel with the drive bit. The sub-piston is slidably movably disposed in the sub-piston cylinder and has a front end. A sub-piston chamber is defined by the sub-piston cylinder and the front end of the sub-piston. The piston rod connects the slide mechanism to the front end of the sub-piston. The introducing means is adapted for introducing a compressed air into the sub-piston chamber for urging the slide mechanism rearwardly.

The second object of the present invention will be attained by providing means for starting introduction of the compressed air into the sub-piston chamber when a cruciform end of the drive bit is brought into engagement with a cruciform groove of the head of the screw held by the screw band. The tip end of the drive bit has the cruciform shape, and each head of the screw is formed with the cruciform groove engageable with the cruciform tip of the drive bit.

The third object of the present invention will be attained by providing means for releasing sealing engagement between a seal ring and the sub-piston cylinder when the screw has just been separated from the screw band. The sub-piston has the seal ring in sealing relation to the sub-piston cylinder.

BRIEF DESCRIPTION OF THE DRAWINGS

In the drawings:

FIG. 10(*b*) is a cross-sectional view showing a position of a sub-piston relative to a sub-piston cylinder at the state shown in FIG. 10(*a*);

FIG. 11(*b*) is a cross-sectional view showing a position of the sub-piston relative to the sub-piston cylinder at the state shown in FIG. 11(*a*);

FIG. 12(*b*) is a cross-sectional view showing a position of the sub-piston relative to the sub-piston cylinder at the state shown in FIG. 12(*a*);

DETAILED DESCRIPTION OF THE PREFERRED EMBODIMENTS

Figure 13:
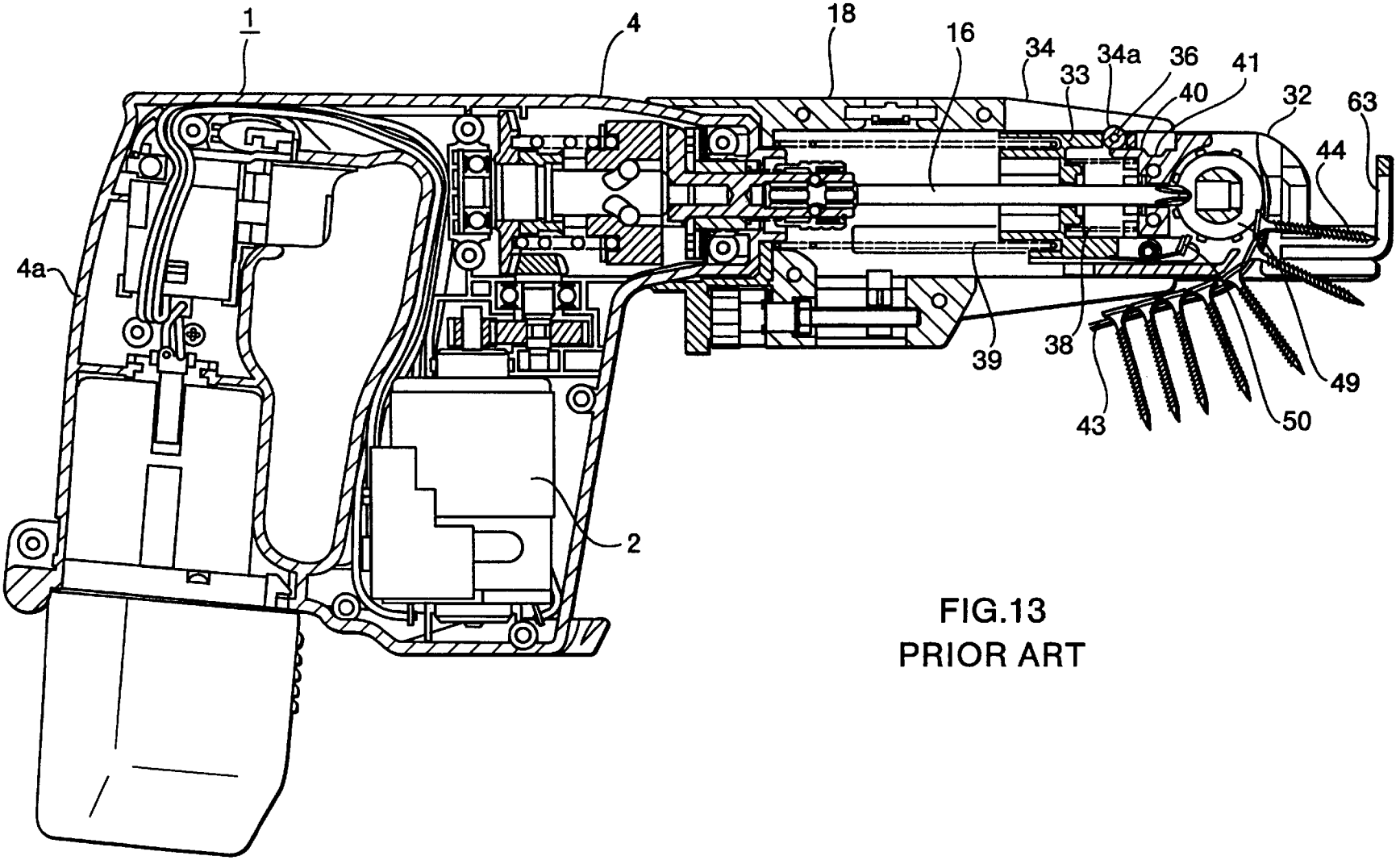
FIG.13 PRIOR ART
FIG. 13 is a cross-sectional side view showing an entire inner construction of a conventional electrically operated screw driver.
Figure 14:
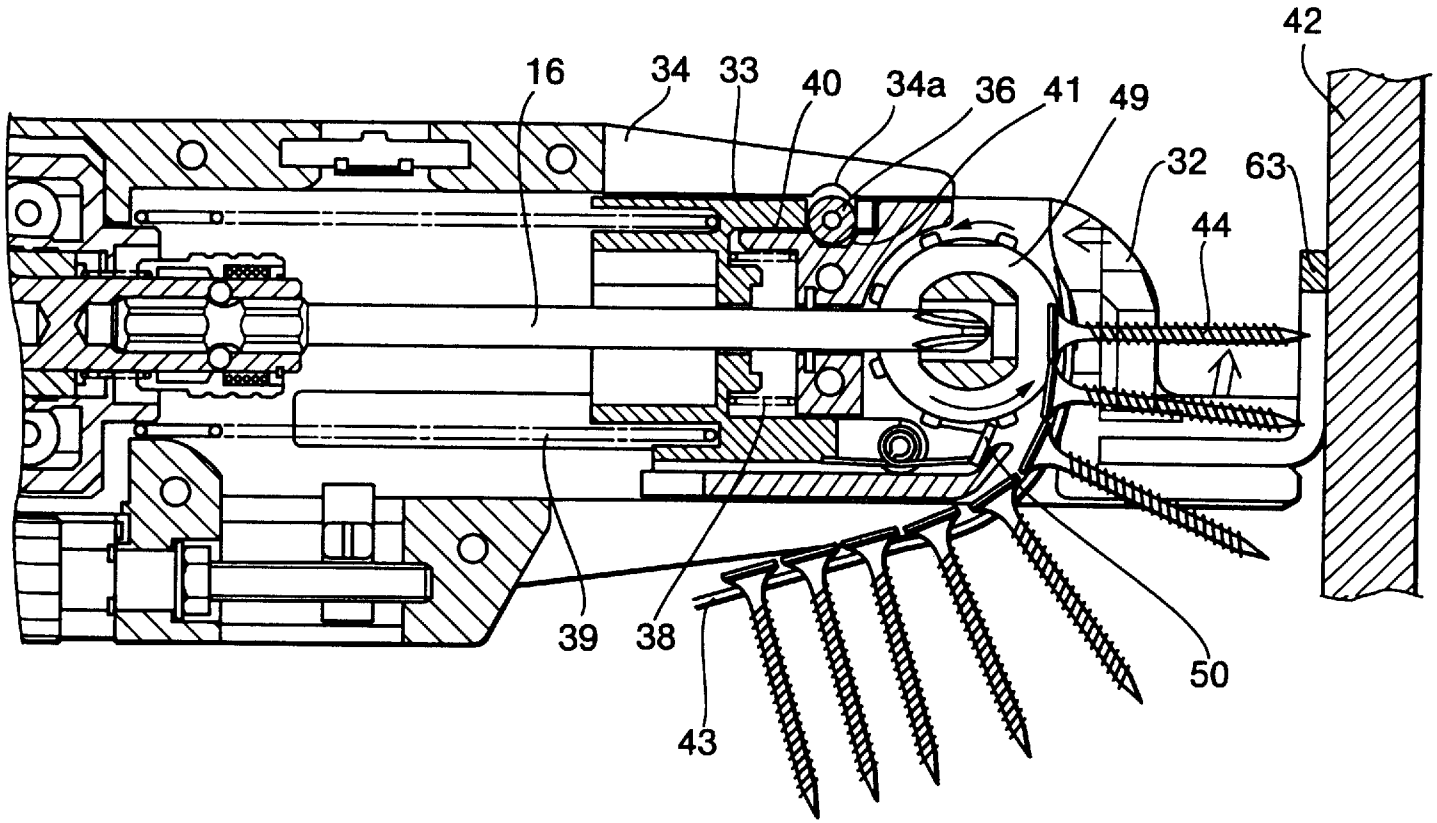
FIG.14 PRIOR ART
FIG. 14 is a partial cross-sectional side view showing a state where a leading end screw is brought into alignment with a drive bit according to the conventional screw driver.

A pneumatically operated screw driver according to a first embodiment of the present invention will be described with reference to FIGS. 1 through 7 wherein like parts and components are designated by the same reference numerals as those shown in FIGS. 13 and 14. The driver includes a main body 1 having a housing 4 and a nose 18. The housing 4 is positioned at a rear side of the nose 18. The housing 4 has a handle 4*a* where an air inlet hole 7 is formed which is connected to an air source (not shown) such as a compressor. The housing 4 accommodates therein a pneumatic motor 2 fluidly connected to the air inlet hole 7 through an air passage 9. Throughout the specification, the handle 4*a* is located at a rearmost side of the screw driver.

In the air passage 9, an air inlet valve chamber 11 is defined in which an air inlet valve 10 is provided for controlling fluid communication between the air inlet hole 7 and the pneumatic motor 2. More specifically, the air inlet valve 10 is adapted to open or close the air passage 9 in accordance with the relative movement of a drive bit 16 (described later) with respect to the main body 1 so as to supply or block a compressed air to the pneumatic motor 2. The air inlet valve 10 is normally urged toward the nose 18 by a spring 14 so as to close the air passage 9 by a seal member 10*a* such as an O-ring. A trigger 51 is pivotably movably supported to the housing 4 for starting screw driving operation. Further, a trigger plate 52 is pivotally movably supported to the trigger 51 at a position abuttable on a front end of the air inlet valve 10 so as to axially move the air inlet vale 10 rearwardly against the biasing force of the spring 14.

The pneumatic motor 2 is driven by the compressed air supplied through the air passage 9. The pneumatic motor 2 has a center shaft 21 rotatably supported to the main body 1 by bearings 19. The center shaft 21 has a rearwardly protruding portion from which a gear wheel 20 is fixedly and coaxially mounted.

An output shaft 17 is slidably provided in the nose 18. The output shaft 17 is axially movable and rotatable about its axis. An impact mechanism 22 is provided in the nose 18 for driving the output shaft 17. The impact mechanism 22 has a gear 20*a* meshedly engaged with the gear 20 of the pneumatic motor 2 for intermittently rotating the output shaft 17. The impact mechanism 22 per se is known in the art, and therefore, a detailed description will be omitted.

The drive bit 16 is provided at a front end of the output shaft 17. More specifically, the output shaft 17 has a front end portion formed with a recessed portion 28 where a ball 29 is provided. In the recessed portion 28, a rear end portion of the drive bit 16 is inserted and engaged with the ball 29. Thus, the drive bit 16 is rotatable about its axis together with the rotation of the output shaft 17, and cannot be removed therefrom.

Figure 1:
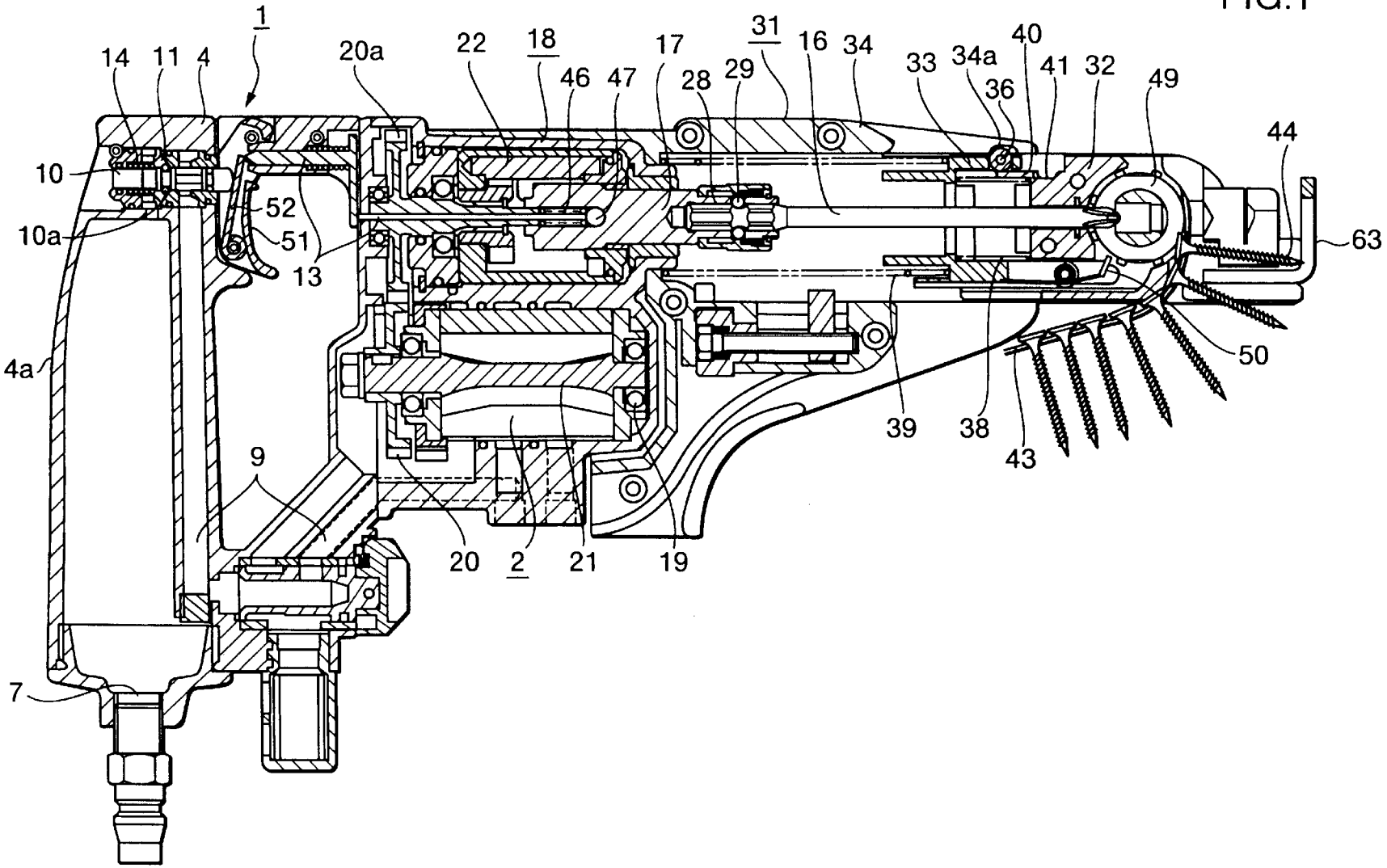
FIG. 1 is a cross-sectional side view showing an entire inner construction of a pneumatically operated screw driver according to a first embodiment of the present invention.
Figure 5:
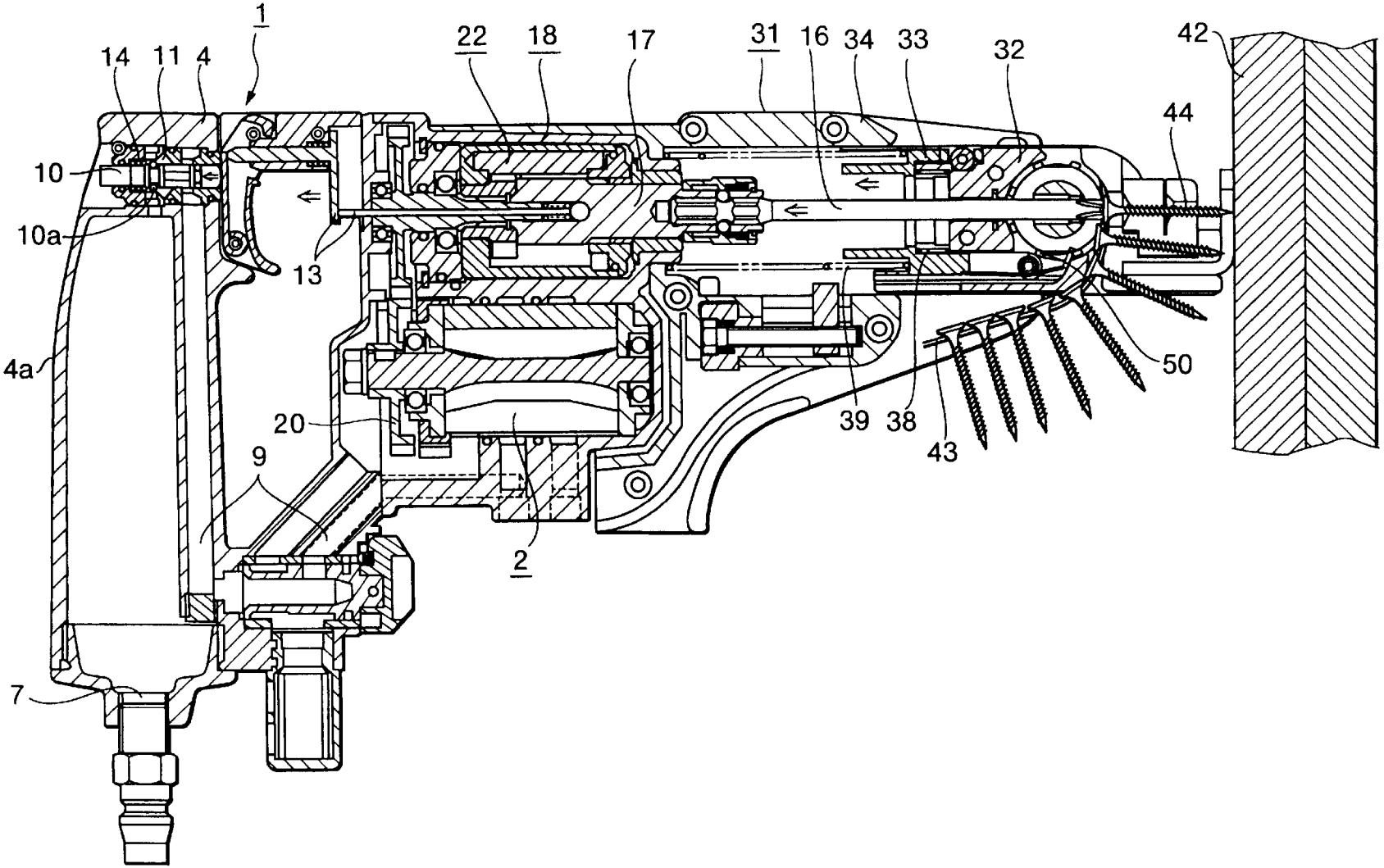
FIG. 5 is a cross-sectional side view showing the entire inner construction in a state where an operation segment is relatively moved rearwardly to press a trigger plate rearwardly according to the first embodiment.

The output shaft 17 has a rear end portion formed with a receiving portion 47 for receiving a front end portion of an operation segment 13. Further, a spring 46 is disposed in the receiving portion 47 for urging the output shaft 17 frontwardly. The operation segment 13 is rearwarly movable upon rearward movement of the output shaft 17 and the drive bit 16. The rear end portion of the operation segment 13 is mechanically associated with the trigger plate 52. Upon rearward movement of the drive bit 16, the output shaft 17 and the operation segment 13 are also rearwardly moved. Therefore, the rear end of the operation segment 13 pushes the trigger plate 52 rearwardly for moving the inlet valve 10 rearwardly against the biasing force of the spring 14 if the trigger 51 is pulled. Thus, the seal member 10*a* releases seal to open the air passage 9 thereby allowing compressed air in a space of the handle 4*a* to flow into the pneumatic motor 2. On the other hand, if the output shaft 17 and the drive bit 16 are moved frontwardly, the inlet valve closes the air passage 9 by the biasing force of the spring 14. Incidentally, FIGS. 1 and 5 show the state where the trigger 51 is pulled. By pulling the trigger 51, the lower pivot portion of the trigger plate 51 is moved rearwardly. In case of FIG. 1, the air inlet valve 10 cannot be shifted even by the pulling of the trigger 51 because the trigger plate 52 is not pressed by the operation segment 13. In case of FIG. 1, the air inlet valve 10 ca be opened by pulling the trigger 51 because the trigger plate 52 is pressed by the operation segment 13.

Figure 3:
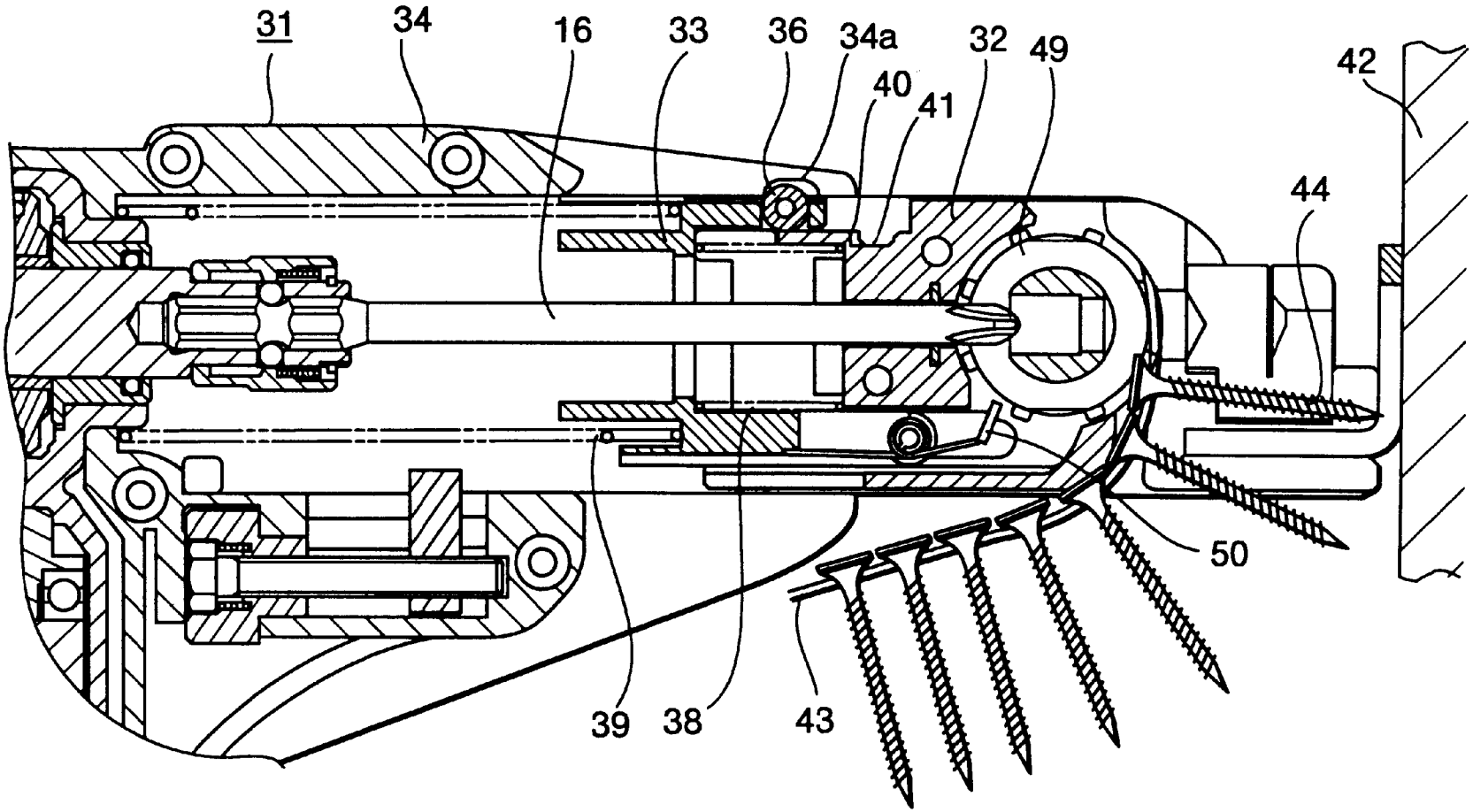
FIG. 3 is a partial cross-sectional side view showing an initially rearwardly moving phase of a first slide member according to the first embodiment.

A feeder unit 31 is provided at a front side of the nose 18 for successively feeding each screw 44 secured to a screw band 43 to a position in front of the drive bit 16. The screw band 43 is made of a resin material and holds a plurality of screws 44 arrayed in a lengthwise direction of the screw band 43 with a constant interval. Each screw 44 is releasable from the screw band 43 when a shearing force is applied to the screw band 43. The feeder unit 31 includes a first slide member 32, a second slide member 33, a casing 34, a spring 38 and a spring 39. The first slide member 32 is positioned at the frontmost end of the screw driver, and has a sprocket 49 engageable with the screw band 43. The first slide member 32 has a flat surface 40 and a groove 41 formed in the flat surface 40. The first slide member 32 has a frontmost end provided with an abutment piece 63 which is abuttable on the workpiece 42 (FIG. 3). The first slide member 32 is formed with a screw passage having a circular cross-section (not shown). The second slide member 33 is positioned immediately behind the first slide member 32. The spring 39 is interposed between the casing 34 and the second slide member 33 for urging the second slide member 33 frontwardly. Further, the spring 38 is interposed between the first and second slide members 32 and 33 for urging the first slide member 32 frontwardly. The biasing force of the spring 39 is greater than that of the spring 38. The second slide member 33 has a roller 36 selectively positioned on the flat surface 40 or engageable with the groove 41. The second slide member 33 also has a feed pawl 50 engageable with the sprocket 49 for rotating the sprocket 49 upon relatively frontward movement of the second slide member 33 with respect to the first slide member 32. The second slide member 33 is slidable with respect to an inner surface of the casing 34. In the inner surface of the casing 34, an engagement groove 34*a* is formed with which the roller 36 can be selectively engaged.

In a non-operation state, the roller 36 is engaged with the engagement groove 34*a* of the casing 34 and rides on the flat surface 40 of the first slide member 32. Upon frontward movement of the main body 1 with respect to a workpiece 42 (FIG. 5) after abutting the abutment piece 63 against the workpiece 42, the first slide member 32 is moved into the casing 34 against the biasing force of the spring 38. Therefore, the feed pawl 50 pushes the sprocket 49 to rotate the sprocket 49, so that the leading end screw 44 held by the screw band 43 is fed to the position in front of the drive bit 16 in axial alignment therewith. In this case, the second slide member 33 is maintained at its frontward position by the biasing force of the spring 39 and by the engagement of the roller 36 with the engagement groove 34*a*.

On the way to rearward movement of the first slide member 32, the roller 36 which has been riding on the flat surface 40 is then disengaged from the engagement groove 34*a* and brought into engagement with the groove 41. Thus, the second slide member 33 is released from the casing 34 and engaged with the first slide member 32. Accordingly, the first and second slide members 32 and 33 are moved together into the casing 34. In the rearward movement of the first and second slide members 32 and 33, the drive bit 16 is brought into engagement with a head of the screw 44, and the screw band 43 is pressed onto the inner wall of the first slide member 32 in accordance with the rearward movement of the first slide member 32. The screw band 43 is deformed along the screw passage formed in the first slide member 32. If the deformation of the screw band 43 exceeds the screw holding force, the screw 44 can be separated from the screw band 43, and passes along the screw passage and screwed into the workpiece 42. If the main body 1 is moved away from the workpiece 42, the first and second slide members 32 and 33 are moved to their original positions by the biasing force of the springs 38 and 39.

Figure 2:
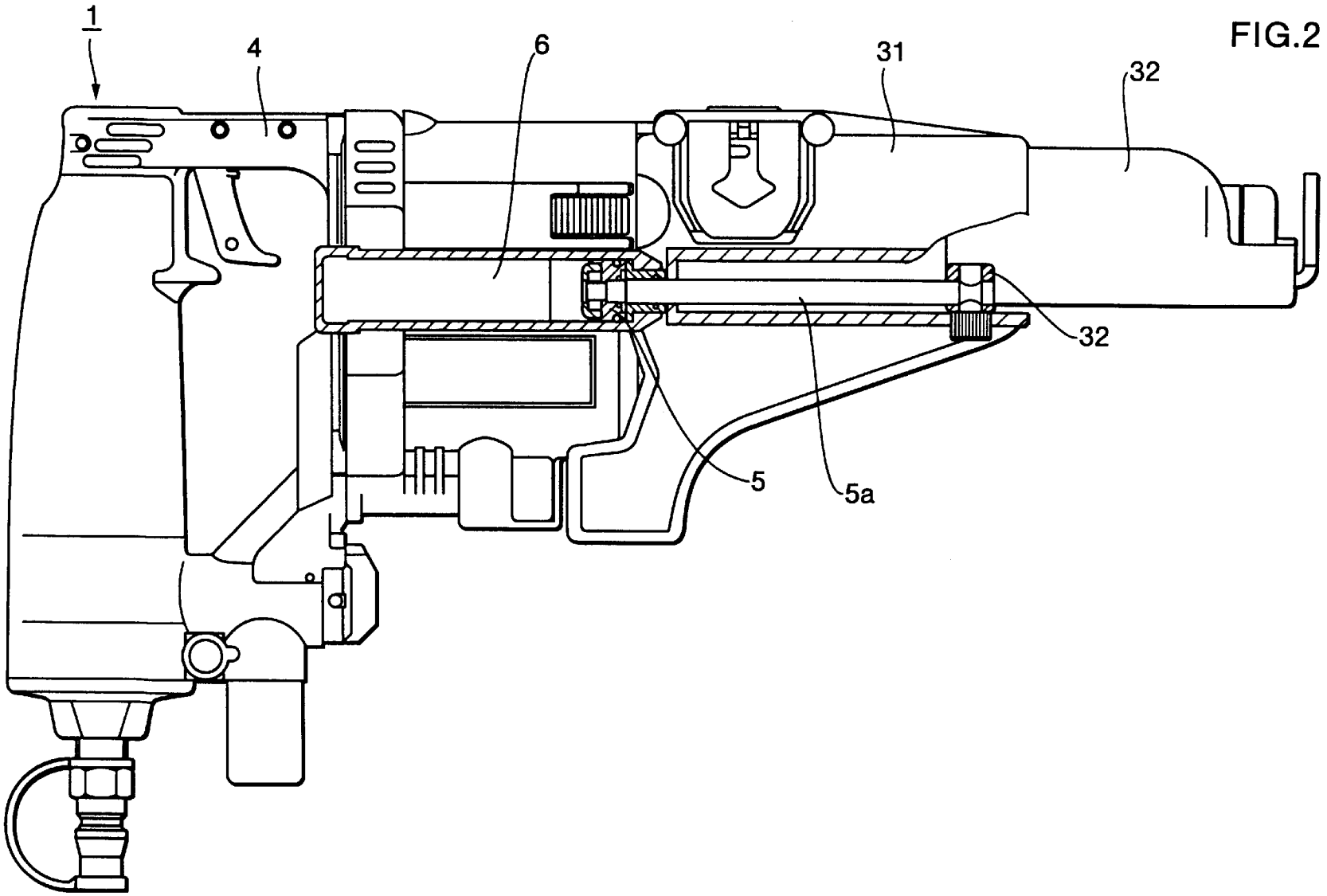
FIG. 2 is a side view showing an essential portion of the first embodiment.
Figure 6:
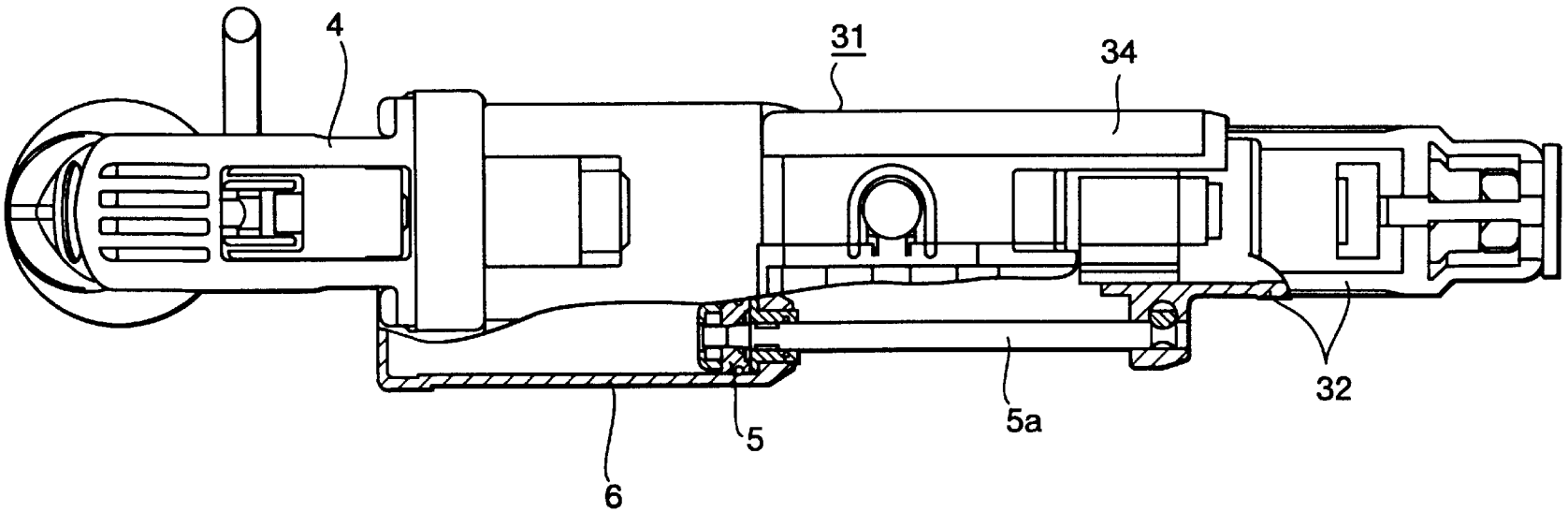
FIG. 6 is a plan view showing the screw driver according to the first embodiment for particularly showing a sub-piston cylinder.
Figure 7:
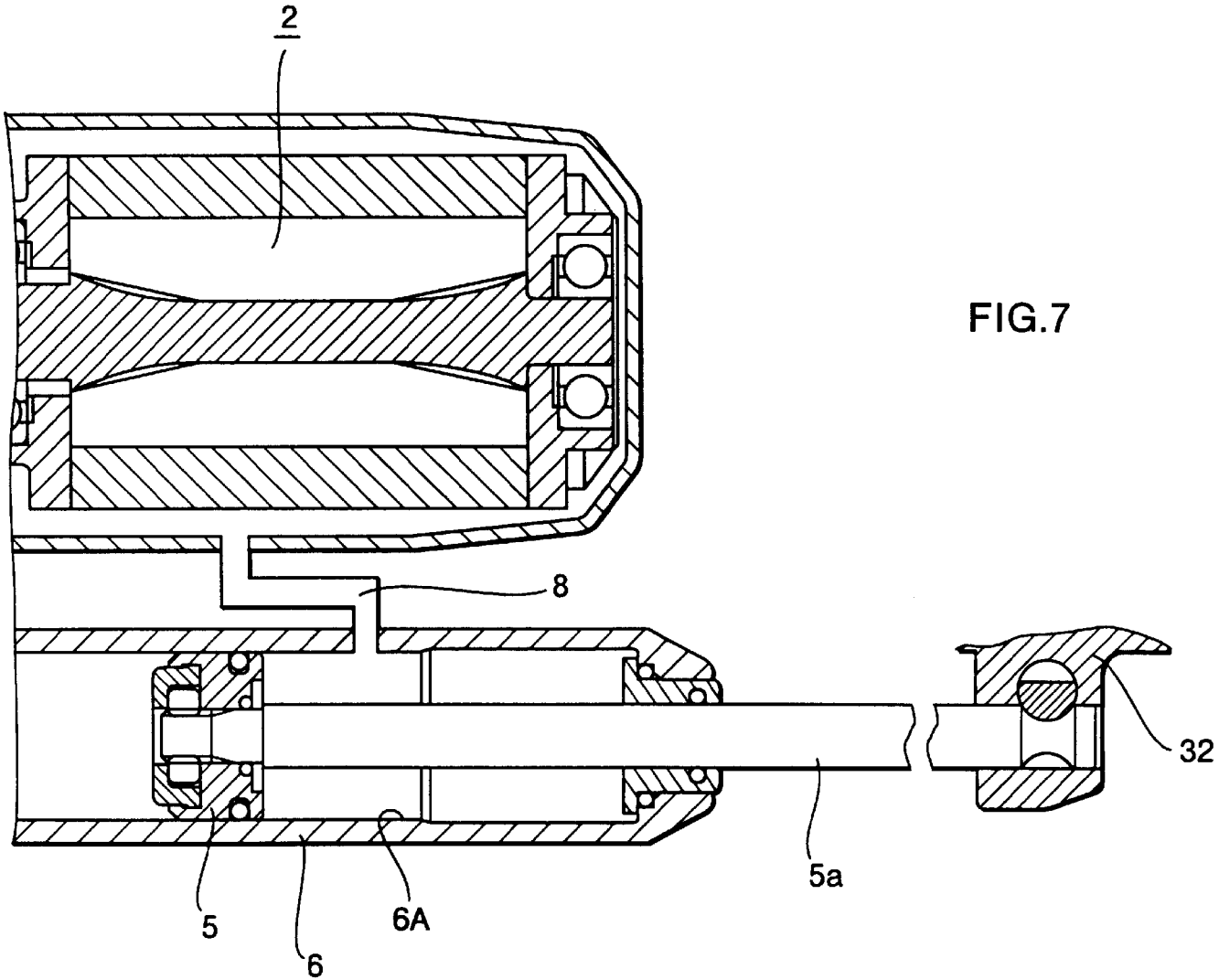
FIG. 7 is a cross-sectional view showing the sub-piston cylinder and a sub-piston according to the first embodiment.

As shown in FIGS. 2, 6 and 7, a sub-piston cylinder 6 extending in a direction parallel with the drive bit 16 is juxtaposed with the housing 4 at a position adjacent the pneumatic motor 2. A sub-piston 5 is slidably disposed in the sub-piston cylinder 6, and a piston rod 5*a* extending in a direction parallel with the drive bit 16 is connected to the sub-piston 5. The piston rod 5*a* has a front end connected to the rear end portion of the first slide member 32. As best shown in FIG. 7, The sub-piston cylinder 6 defines therein a sub-piston chamber 6A in fluid communication with the pneumatic motor 2 through an air passage 8. More specifically, the air passage 8 is open to a sub-piston chamber 6A at a position in front of the sub-piston 5, so that the sub-piston 5 can be moved rearwardly upon introduction of the compressed air into the sub-piston chamber 6A. The sub-piston cylinder 6 has a rear wall where an air discharge hole (not shown) is formed through which a back-pressure at the rear side of the sub-piston 5 can be discharged. The compressed air is introduced into the sub-piston chamber 6A through the air passage 8, if a compressed air is introduced into the pneumatic motor 2 through the air passage 9 and the air inlet valve 10. Further, the compressed air in the sub-piston chamber 6A can be discharged outside through the air passage 8 and the pneumatic motor 2 when the rotation of the pneumatic motor 2 is stopped.

Next operation sequence will be described.

Phase 1: A compressed air is introduced into the handle 4*a* through the air inlet 7 if an air plug (not shown) is operated. However, since the trigger plate 52 is not pivotally moved by the operation segment 13, the air inlet valve 10 is maintained in its valve-closing state to block the air passage 9.

Phase 2: If the main body 1 is moved frontwardly to permit the abutment piece 63 to press against the workpiece 42 as shown in FIG. 3, the casing 34 and the second slide member 33 are also moved frontwardly. In other words, the first slide member 32 is relatively moved rearwardly, and the sub-piston 5 is also moved rearwardly because of the mechanical connection of the first slide member 32 to the piston rod 5*a*.

Figure 4:
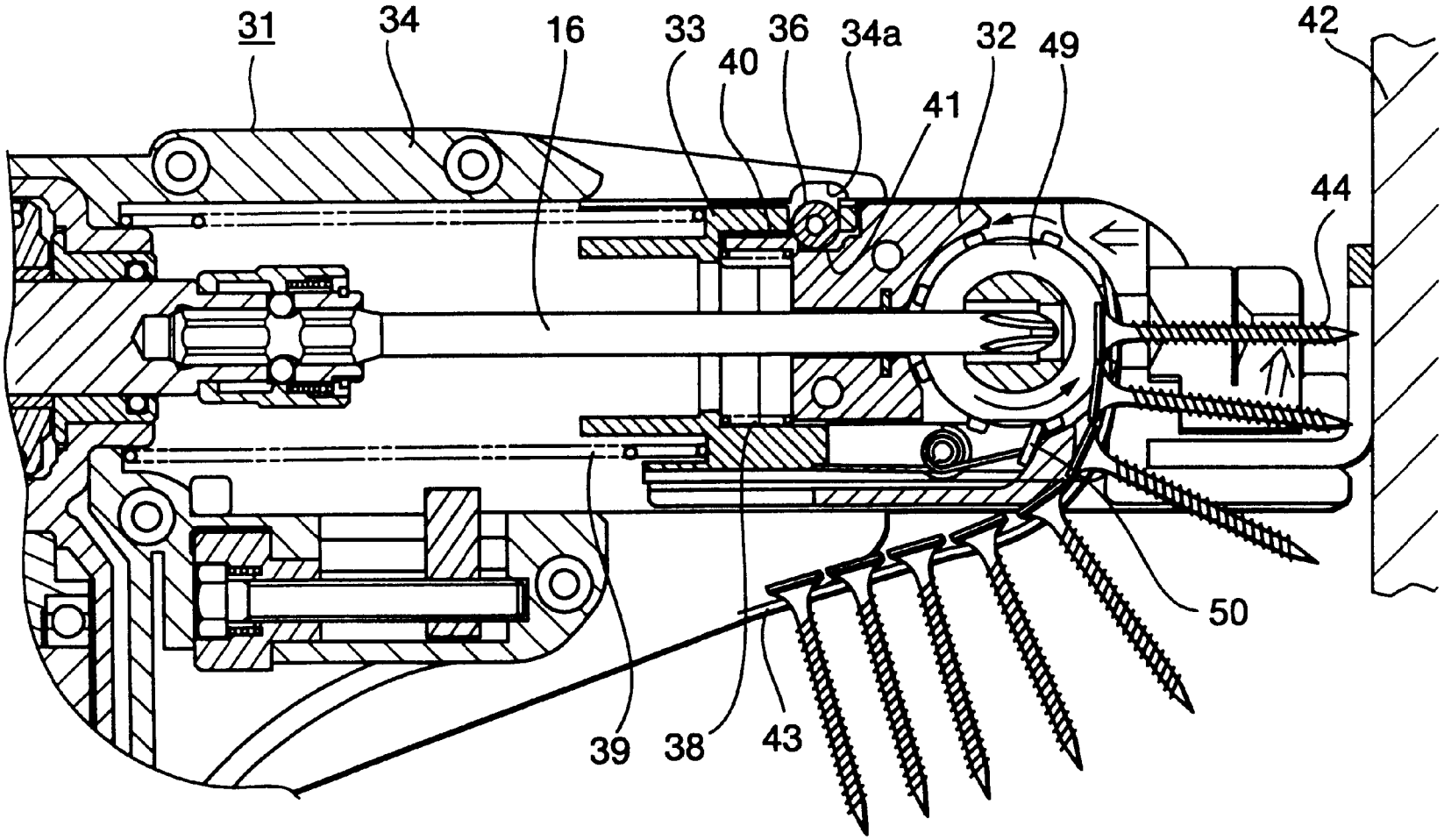
FIG. 4 is a partial cross-sectional side view showing a state where a leading end screw is brought into alignment with a drive bit according to the first embodiment.

Phase 3: If the main body 1 is further moved frontwardly, the roller 36 is brought into engagement with the groove 41 of the first slide member 32, so that the first and second slide members 32 and 33 can be integrally moved rearwardly relative to the casing 34. In this case, the sub-piston 5 is further moved rearwardly. At the same time, the feed pawl 50 rotates the sprocket 49 to feed the leading end screw 44 to a position in front of and in alignment with the drive bit 16 as shown in FIG. 4.

Phase 4: If the main body 1 is further moved frontwardly, the drive bit 16 is brought into engagement with the head of the screw 44 (for example, a cruciform groove of the head), and the first slide member 32 abuts the screw band 43. In this case, a shearing force is first imparted on the screw band 43 by the drive bit 16 and the first slide member 32. Further, the drive bit 16 and the output shaft 17 are relatively moved rearwardly because of the main body 1 is continuously pressed toward the workpiece 42. Accordingly, the operation segment 13 is also relatively moved rearwardly to press the trigger plate 52 rearwardly. Consequently, the air inlet valve 10 is moved rearwardly to open the air passage 9 as shown in FIG. 5.

Phase 5: Upon opening motion of the air inlet valve 10, the compressed air is introduced into the pneumatic motor 2, so that the pneumatic motor 2 is rotated. The rotation of the pneumatic motor is transmitted to the output shaft 17 through the impact mechanism 22. Therefore, the output shaft 17 and the drive bit 16 are intermittently driven to be rotated to fix the screw 44 into the workpiece 42.

Further, the compressed air is also introduced from the pneumatic motor 2 into the sub-piston chamber 6A through the air passage 8. Accordingly, the first slide member 32 is urged rearwardly by the sub-piston 5. This urging force can reduce pressing force imparted to the main body against the workpiece by the operator. More specifically, in order to separate the screw 44 from the screw band 43, deformation of the screw band 43 is required. This separation force is mainly provided by the thrusting force transmitted to the screw 44 from the drive bit 16, while the screw band 43 is pressed onto the wall of the first slide member 32. To this effect, the operator must press the main body 1 against the workpiece 42 in order to promote deformation of the screw band 43. In this case, the deformation can be accelerated by the rearward movement of the first slide member 32 because of the provision of the sub-piston arrangement. Consequently, operator's pressing force against the workpiece 42 can be reduced, to enhance operability of the screw driver.

Phase 6: At a terminal phase of the screw driving operation, while maintaining pressing the main body 1 toward front, the drive bit 16 and the operation segment 13 are moved frontwardly in accordance with the advancement of the threading engagement of the screw 44 with the workpiece 42, so that the rear end of the operation segment 13 is moved away from the trigger plate 52. Therefore, the trigger plate 52 is moved to its initial position to close the air inlet valve 10 by the biasing force of the spring 14. Therefore, the rotation of the pneumatic motor 2 is stopped, and at the same time, compressed air supply to the sub-piston chamber 6A is also stopped. Air in the sub-piston chamber 6A is discharged outside through the air passage 8 and the pneumatic motor 2.

Phase 7: If the main body 1 is moved away from the workpiece 42 upon completion of the screw driving operation, the first slide member 32 and the second slide member 33 are moved frontwardly to their original positions by the biasing force of the springs 38 and 39. Further, the rod 5*a* and the sub-piston 5 are also moved frontwarly as shown in FIG. 2 because of the mechanical connection to the first slide member 32.

A pneumatically operated screw driver according to a second embodiment of the present invention will next be described with reference to FIGS. 8 through 13. The second embodiment pertains to an improvement on the first embodiment for avoiding accidental inclination of the screw to be driven with respect to the drive bit 16 or inclination of the main body 1 with respect to the workpiece 42. More specifically, at the Phase 5 of the first embodiment, introduction of the compressed air into the sub-piston chamber 6A occurs concurrently with the start of rotation of the pneumatic motor 2 so as to move the sub-piston 5 rearwardly to urge the first slide member 32 rearwardly. By the rearward movement of the first slide member 32, separation of the screw 44 from the screw band 43 can be promoted. However, the separation may also occur in a state where the tip end of the drive bit 16 is not engaged with the cruciform groove of the head of the screw 44, but merely presses the surface of the head other than the cruciform groove. If this is the case, the screw may be undesirably inclined with respect to the workpiece 42.

Figure 8:
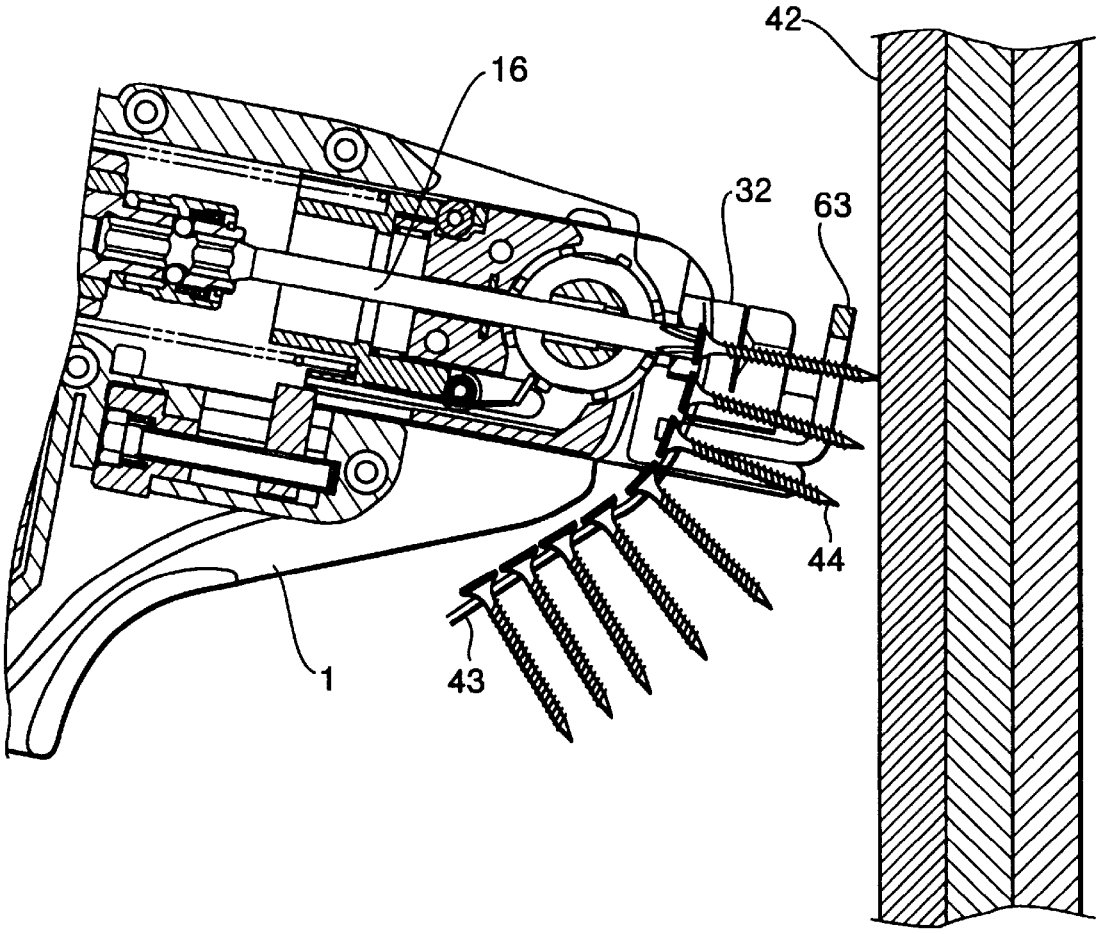
FIG. 8 is a partial cross-sectional view showing an accidental inclined posture of the screw driver according to the first embodiment with respect to a workpiece.

Separation of the screw 44 from the screw band 43 requires a resistive force for causing deformation of the screw band 43, and a force balance is provided during shearing of the screw band 43 among pressing forces (a) the drive bit 16 pressing against the screw, (b) screw 44 pressing against the screw band 43, and (c) first slide member 32 pressing against the screw band 43. Upon release of the screw 44 from the screw band 43, the resistance is immediately lowered, and the force imbalance occurs because the force (b) disappears. As a result, the pressing force (c) becomes undesirable. More specifically, if the sub-piston 5 urges the first slide member 32 rearwardly even after complete release of the screw 44 from the screw band 43, the entire screw driver may be urged rearwardly due to the force imbalance. As a result, the abutment piece 63 may be moved away from the surface of the workpiece 42 prior to initial threading engagement of the screw 44 into the workpiece 42. In this case, the main body 1 of the screw driver is merely supported on the workpiece surface by only a tip end of the screw 44 as shown in FIG. 8. This may cause inclination of the main body 1 relative to the workpiece 42. The second embodiment is established in an attempt to solve the above-mentioned drawbacks.

Figure 9:
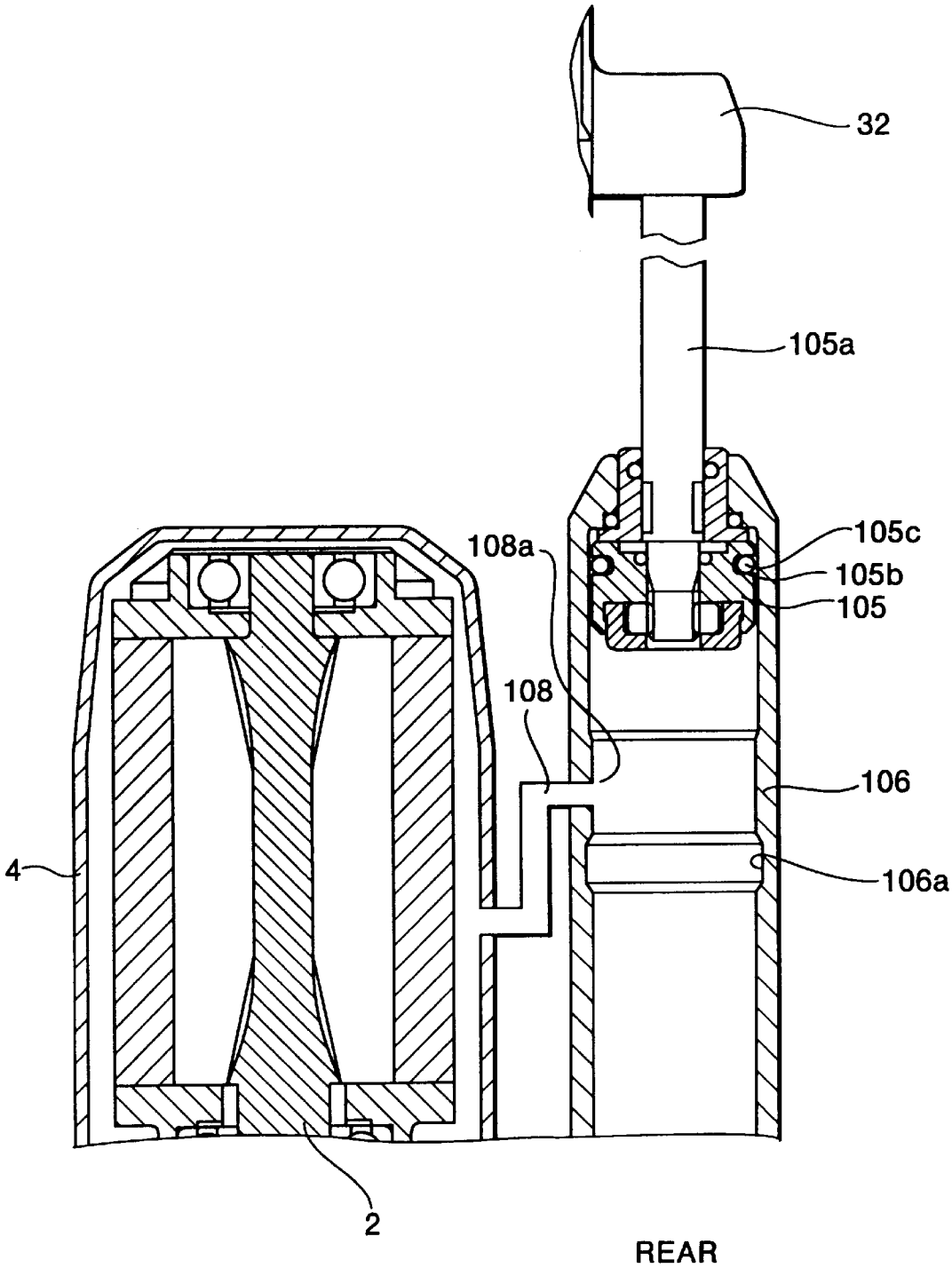
FIG. 9 is a cross-sectional view showing a sub-piston cylinder and a pneumatic motor of a screw driver according to a second embodiment of the present invention.

The second embodiment has the structure substantially the same as that of the first embodiment except a sub-piston cylinder 106 as shown in FIG. 9. Similar to the first embodiment, the sub-piston cylinder 106 is juxtaposed with the housing 4, and the sub-piston 105 is slidably disposed in the sub-piston cylinder 106. The sub-piston 105 is connected to a piston rod 105*a* whose front end is connected to the first slide member 32. The front end surface of the sub-piston 105 and the sub-piston cylinder 106 define a sub-piston chamber 106A which is in fluid communication with the pneumatic motor 2 by an air passage 108. This arrangement is the same as the first embodiment. Incidentally, the sub-piston 105 is formed with an annular groove 105*b* in which a seal ring 105*c* is assembled. The seal ring 105*c* is adapted for sealing engagement with the inner peripheral surface of the sub-piston cylinder 106.

In the second embodiment, attention is drawn to a position of an opening 108*a* of the air passage 108 with respect to the sub-piston chamber 106A, and formation of an annular stepped portion 106*a* at an inner peripheral surface of the sub-piston cylinder 106.

Figure 10:
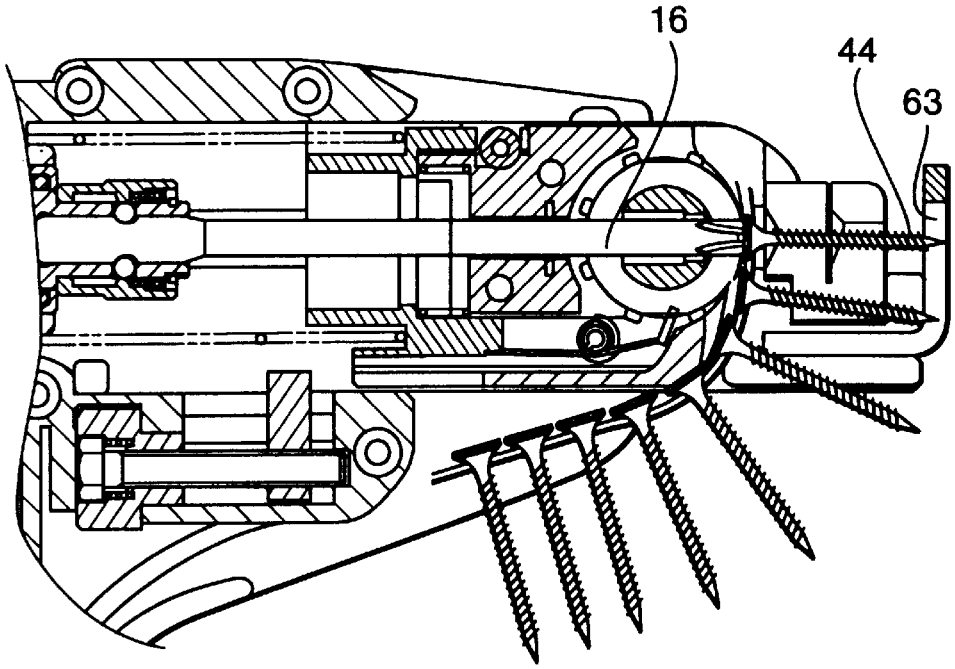
FIG. 10(*a*) is a cross-sectional view showing a state where the tip end of the drive bit is completely engaged with a cruciform groove of a head of the screw according to the second embodiment.
Figure 10:
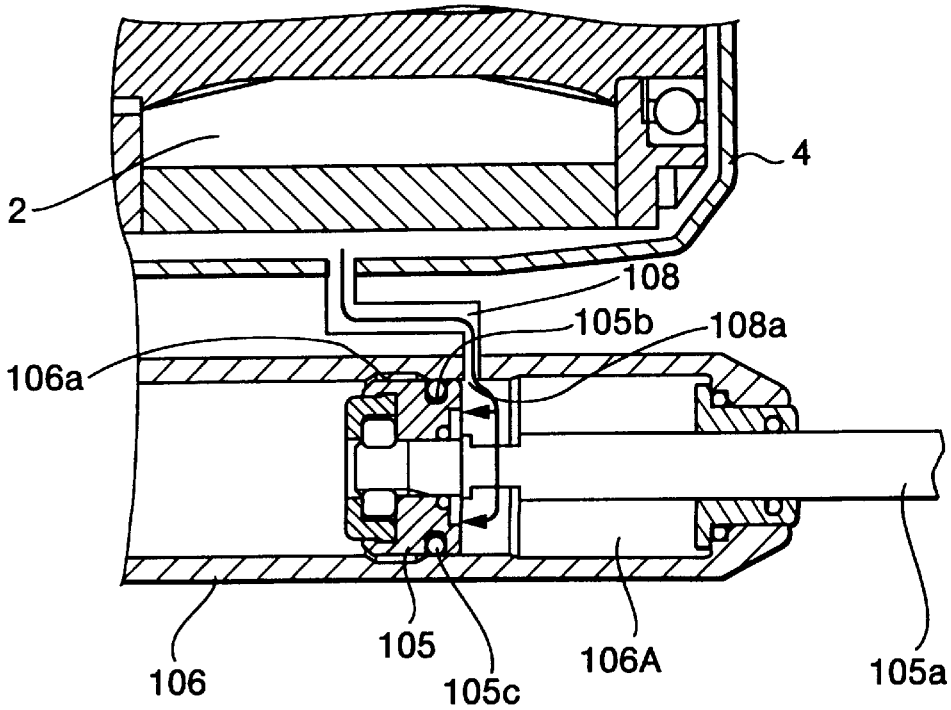
Figure 11:
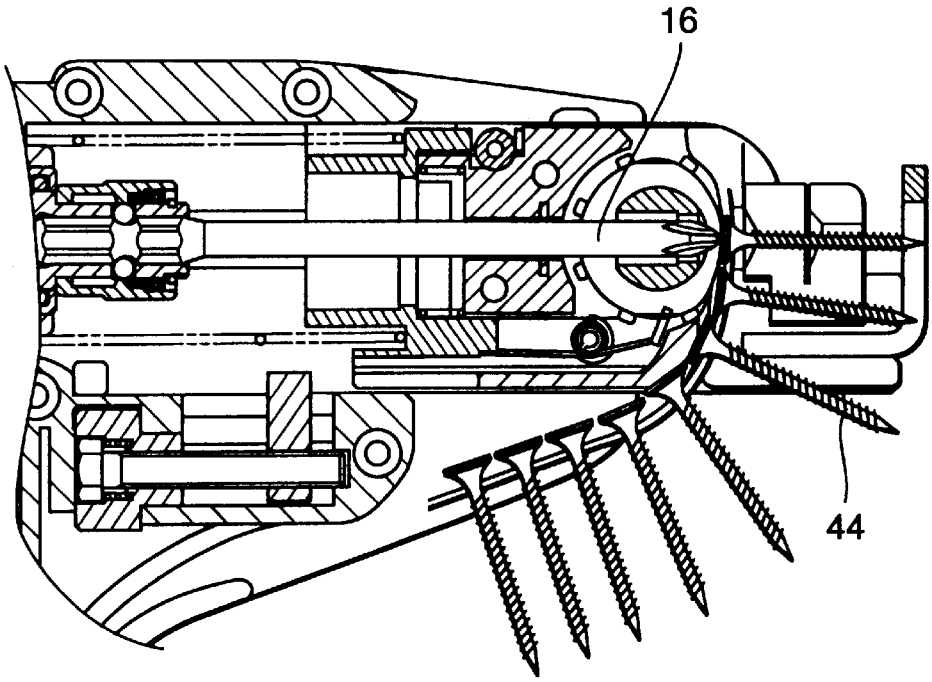
FIG. 11(*a*) is a cross-sectional view showing a state where a tip end of a drive bit is not engaged with the cruciform groove according to the second embodiment.
Figure 11:
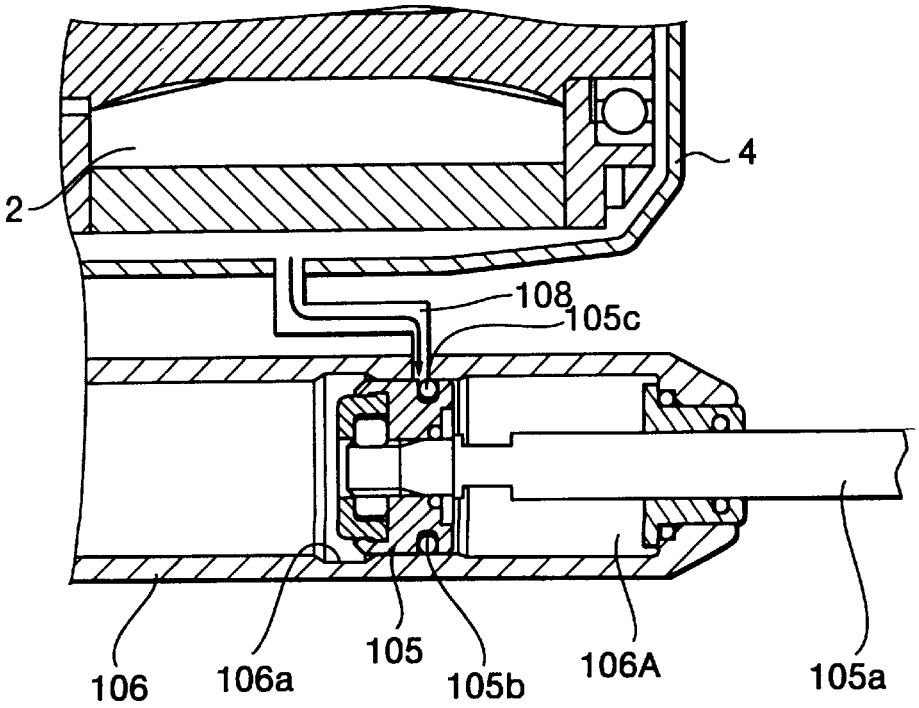

First, the determination of the position of the opening 108*a* open to the sub-piston chamber 106A will be described. At a starting phase of the Phase 5 described above, there may be the case where the tip end of the drive bit 16 has completely been engaged with the cruciform groove of the head of the screw 44 as a result of the Phase 4 as shown in FIG. 10(*a*), or there may be also the case where the tip end of the drive bit 16 is not engaged with the cruciform groove but merely presses the flat surface of the head other than the cruciform groove as shown in FIG. 11(*a*). In the latter case, the rearward moving length of the first slide member 32 into the casing 34 is smaller than that in the case where the tip end of the drive bit 16 is completely engaged with the cruciform groove. More specifically, the rearward movement of the first slide member 32 is temporarily stopped upon contact of the tip end of the drive bit 16 with the surface of the screw head. The first slide member 32 could have been moved further leftwardly "by the depth of the cruciform groove", if the tip end of the drive bit 16 were engaged with the cruciform groove. Further, in the latter case, the tip end of the drive bit 16 can become completely engaged with the cruciform groove after driving the pneumatic motor 2 which rotates the drive bit 16.

Taking the above in view, the opening position of the opening 108*a* of the air passage 108 is determined such that during the rearward moving stroke of the first slide member 32 into the housing 4, the opening 108*a* is positioned rearwardly with respect to the seal ring 105*c* of the sub-piston 105 for preventing the compressed air from being introduced into the sub-piston chamber 106A as shown in FIG. 11(*b*), if the tip end of the drive bit 16 has not yet been engaged with the cruciform groove of the screw head, and the opening 108*a* is positioned frontwardly with respect to the seal ring 105*c* for allowing the compressed air to flow into the sub-piston chamber 106A as shown in FIG. 10(*b*), in case the tip end of the drive bit 16 is engaged with the cruciform groove.

With this arrangement, the pneumatically driving force of the sub-piston 105 is only applied to the first slide member 32 after complete engagement of the tip end of the drive bit 16 with the cruciform groove of the head of the screw 44 for assisting separation of the screw 44 from the screw band 43. As a result, the screw can be driven with a correct orientation with respect to the workpiece 42.

Figure 12:
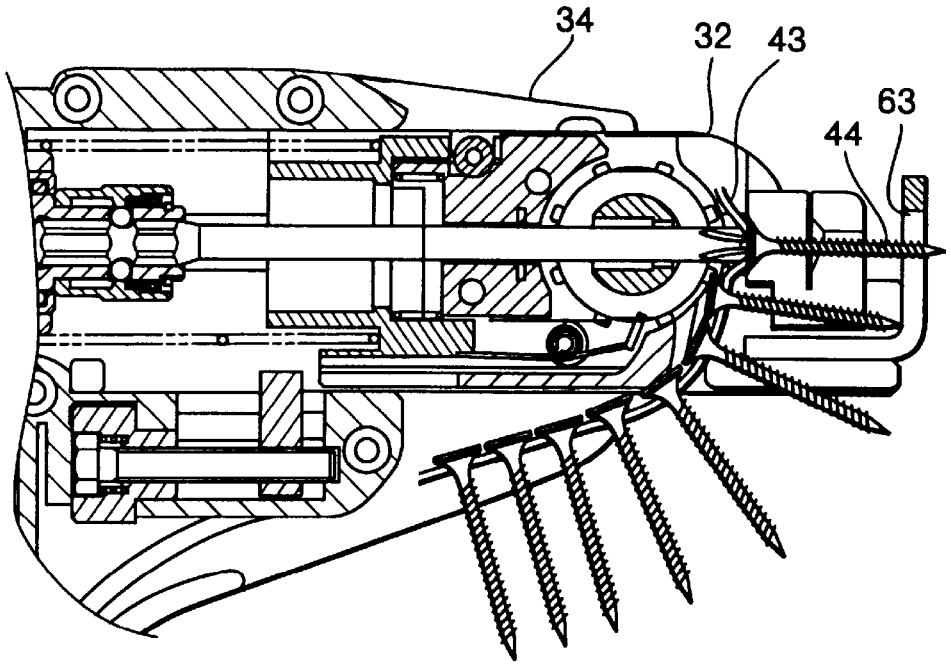
FIG. 12(*a*) is a cross-sectional view showing a state where the screw has just been separated from the screw band according to the second embodiment.
Figure 12:
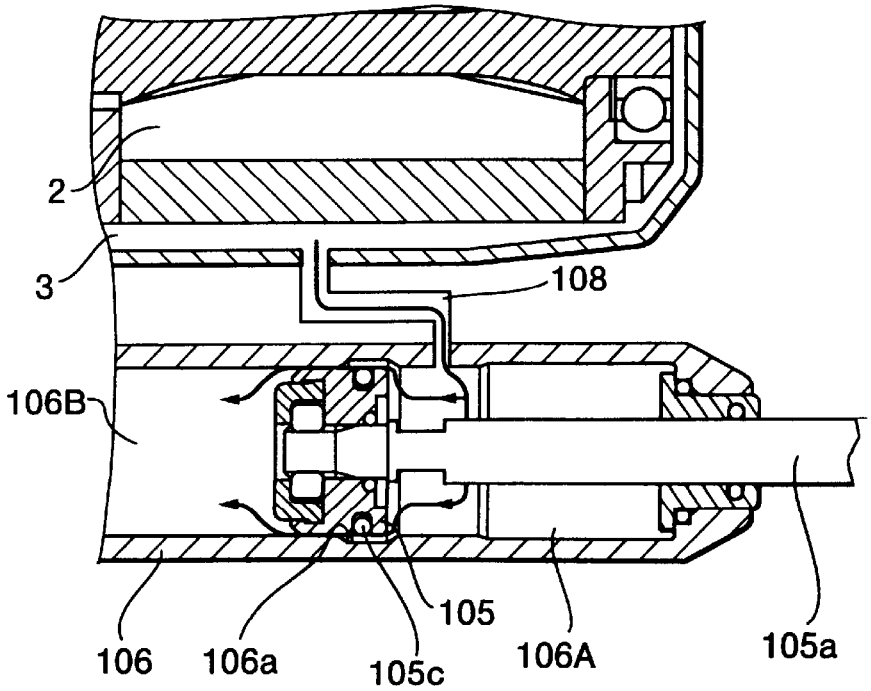

Next, the formation of the annular stepped portion 106*a* at an inner peripheral surface of the sub-piston cylinder 106 will be described. The annular stepped portion 106*a* is positioned rearwardly with respect to the opening 108*a*. The position of the annular stepped portion 106*a* corresponds to a timing at which the screw 44 has just released from the screw band 43 in the rearward moving stroke of the sub-piston 105 as shown in FIG. 12(*a*). The annular stepped portion 106*a* is adapted for allowing the compressed air in the sub-piston chamber 106A to be positively leaked toward a rear space 106B of the sub-piston cylinder 106 when the seal ring 105*c* is brought into alignment with the annular stepped portion 106*a* during rearward movement of the sub-piston 105. That is, a gap is provided between the annular stepped portion 106*a* and the outer peripheral surface of the seal ring 105*c* at the phase of the alignment therebetween.

With this arrangement, during rearward moving stroke of the sub-piston 105 by the introduction of the compressed air into the sub-piston chamber 106A, the seal ring 105*c* moves past the annular stepped portion 106*a*. In this case, the compressed air in the sub-piston chamber 106A can be leaked into the space 106B through the gap between the seal ring 105*c* and the annular stepped portion 106*a*. By this leakage, the pneumatically force for urging the sub-piston 105 rearwardly is immediately reduced. Because this timing corresponds to the complete separation of the screw 44 from the screw band 43, the leakage can reduce or disappear the force (c) described above. As a result, the leakage can prevent the entire screw driver from being excessively urged rearwardly to avoid separation of the abutment piece 63 from the surface of the workpiece 42.

While the invention has been described in detail and with reference to the specific embodiments thereof, it would be apparent to those skilled in the art that various changes and modifications may be made therein without departing from the spirit and scope of the invention.

What is claimed is:

1. A pneumatically operated screw driver connected to a compressed air source for driving a screw held by a screw band into a workpiece, the screw band detachably holding a plurality of screws arrayed in line with a constant interval, and the screw band having one side where each head of each screw is exposed, and having another side from which each threading portion of each screw extends, the screw driver comprising:

a housing formed with an compressed air inlet connected to the compressed air source;

a pneumatic motor disposed in the housing and selectively communicated with the compressed air source, the pneumatic motor being driven by a compressed air supplied from the compressed air source;

a drive bit disposed in the housing and rotationally driven by the pneumatic motor, the drive bit having a tip end engageable with the head of the screw held in the screw band;

a casing supported to the housing and extending in the axial direction of the drive bit;

a slide mechanism slidably disposed in the casing, the slide mechanism being slidable upon pressing the housing onto the workpiece, the slide mechanism having a front portion provided with a screw feed mechanism movably holding the screw band for feeding each screw held by the screw band to a position adjacent the tip end of the drive bit and in axial alignment therewith in accordance with the sliding movement of the slide mechanism, the head of each screw being pressed by the tip end of the drive bit, and the another side of the screw band being supported by the slide mechanism; and a mechanism for facilitating a separation of the screw from the screw band, the facilitating mechanism comprising:

a sub-piston cylinder disposed at the housing and extending in a direction parallel with the drive bit;

a sub-piston slidably movably disposed in the sub-piston cylinder and having a front end, a sub-piston chamber being defined by the sub-piston cylinder and the front end;

a piston rod connecting the slide mechanism to the front end of the sub-piston; and means for introducing a compressed air into the sub-piston chamber for urging the slide mechanism rearwardly.

2. The pneumatically operated screw driver as claimed in claim 1, wherein the introducing means comprises a passage means fluidly connecting the pneumatic motor to the sub-piston chamber for introducing the compressed air into the sub-piston chamber from the pneumatic motor when the compressed air is introduced into the pneumatic motor.

3. The pneumatically operated screw driver as claimed in claim 2, wherein the introducing means further comprises a compressed air inlet valve selectively allowing fluid communication between the compressed air source and the pneumatic motor in response to the axial movement of the drive bit.

4. The pneumatically operated screw driver as claimed in claim 2, wherein the sub-piston has a seal ring in sealing relation to the sub-piston cylinder, the seal ring having an outer diameter;

and wherein the tip end of the drive bit has a cruciform shape, and each head of the screw is formed with a cruciform groove engageable with the cruciform tip of the drive bit;

and the screw driver further comprising means for starting introduction of the compressed air into the sub-piston chamber when the cruciform end of the drive bit is brought into engagement with the cruciform groove of the head of the screw held by the screw band.

5. The pneumatically operated screw driver as claimed in claim 4, wherein the starting means comprises a geometrical relation between a position of an open end of the passage means opening to the sub-piston chamber and a moving position of the seal ring in such a manner that the seal ring is positioned frontwardly of the open end to avoid introduction of the compressed air from the pneumatic motor into the sub-piston chamber if the cruciform end of the drive bit has not yet been engaged with the cruciform groove of the head of the screw held by the screw band, and the seal ring is positioned rearwardly of the open end to allow the compressed air to flow from the pneumatic motor into the sub-piston chamber, if the cruciform end of the drive bit has been engaged with the cruciform groove.

6. The pneumatically operated screw driver as claimed in claim 5, wherein the screw band is formed of a deformable material so that the head of the screw can separated from the screw band by deformation thereof upon pressure to the screw band;

and the screw driver further comprising means for releasing sealing engagement between the seal ring and the sub-piston cylinder when the screw has just been separated from the screw band.

7. The pneumatically operated screw driver as claimed in claim 6, wherein the releasing means comprises the sub-piston cylinder formed with an annular groove, the annular groove having an inner diameter greater than the outer diameter of the seal ring, and is positioned rearwardly of the open end.

8. The pneumatically operated screw driver as claimed in claim 7, wherein the annular groove is positioned to confront the seal ring when the sub-piston is moved to a position corresponding to a phase of separation of the screw from the screw band.

* * * * *